US006780369B1

(12) United States Patent
Darrow et al.

(10) Patent No.: US 6,780,369 B1
(45) Date of Patent: Aug. 24, 2004

(54) METHOD OF FINISHING PLASTIC CONCRETE MIXTURE

(75) Inventors: Darrell Darrow, Chesapeake, VA (US); Glenn F. Rogers, Jr., Hampton, VA (US); Samuel A. Face, Jr., Norfolk, VA (US); David Francis, Norfolk, VA (US); Michael Davis, Chesapeake, VA (US); Yuting Wang, Norfolk, VA (US)

(73) Assignee: Face International Corp., Norfolk, VA (US)

( * ) Notice: Subject to any disclaimer, the term of this patent is extended or adjusted under 35 U.S.C. 154(b) by 0 days.

(21) Appl. No.: 09/364,892

(22) Filed: Aug. 2, 1999

(51) Int. Cl.[7] ..... B28B 1/093; B28B 1/10; B28B 11/08

(52) U.S. Cl. ..... 264/426; 264/69; 264/71; 264/162; 264/256; 264/333

(58) Field of Search ..... 264/71, 256, 162, 264/34, 333, 426, 69

(56) References Cited

U.S. PATENT DOCUMENTS 2,296,453 A * 9/1942 Saffert
4,105,816 A * 8/1978 Hori ..... 425/159
4,496,504 A * 1/1985 Steenson et al. ..... 264/69
4,748,788 A * 6/1988 Shaw et al. ..... 52/742
4,775,262 A * 10/1988 Guntharp et al. ..... 404/103
5,173,233 A * 12/1992 Kafarowski ..... 264/113
5,339,589 A * 8/1994 Thrower ..... 52/318
5,441,677 A * 8/1995 Phillips, Sr. ..... 264/31
5,520,862 A * 5/1996 Face, Jr. et al. ..... 264/40.1
5,855,958 A * 1/1999 Nash ..... 427/274

FOREIGN PATENT DOCUMENTS

JP 10-151612 A * 6/1998 ..... B28B/1/16

* cited by examiner

*Primary Examiner*—Jan H. Silbaugh
*Assistant Examiner*—Michael I. Poe
(74) *Attorney, Agent, or Firm*—Stephen E. Clark; David J. Bolouc

(57) ABSTRACT

A method of finishing concrete using a vibrating tool to consolidate a "dry shake" aggregate into the upper layer of the concrete. The use of the vibrating tool causes moisture within the concrete mass to migrate into the surface layer where the moisture may hydrate the aggregates in the dry shake mixture. The ability to cause upward migration of water in the concrete mass provides a larger window of finishability for the concrete. The vibrations also provide thorough consolidation of aggregates in the upper layer of the concrete mass helping to prevent delamination.

5 Claims, 8 Drawing Sheets

METHOD OF FINISHING PLASTIC CONCRETE MIXTURE

BACKGROUND OF THE INVENTION

1. Field of Invention

The present invention generally relates to a method for finishing a plastic concrete mixture. More particularly, the present invention relates to a method for introducing and consolidating a dry shake aggregate additive into plastic concrete mixtures using a vibrational finishing tool.

2. Description of the Prior Art

In constructing concrete structures, such as concrete slabs and the like, certain conventional procedures involve placing a plastic concrete mass inside of a form and finishing the top surface in various well known manners and permitting the concrete to harden with no vibration of the concrete mass whatsoever. Other procedures involve the use of vibrators placed temporarily into or upon the concrete mass at various locations, with the surface being finished by using various combinations of striking off the surface and/or troweling operations, including the use of hand trowels, powered rotary trowels and the like. It is also generally known that, if not worked, the surface of wet concrete would take on a highly undesirable rough and uneven finish which, after partial setting of the concrete, would render the surface difficult if not impossible to finish to the desired smooth and even consistency.

The conventional process for pouring and finishing concrete is labor intensive and consists of the steps of:

1. Pouring fresh concrete into forms.
2. Screeding or striking off the concrete to preliminarily level the surface of the concrete.
3. Tamping the concrete i.e., with a bull float or similar device to bring the finer aggregates to the surface.
4. Applying a "dry shake" aggregate to harden and/or color the concrete.
5. Moving a bull float over the surface of the wet concrete to mix the "dry shake" with the upper layer of the concrete.
6. Moving another rectangular tool such as a hand trowel or fresno, over the bull floated concrete.
7. Allowing the concrete to dry an amount sufficient to support the weight of an individual.
8. Utilizing a power trowel to put a smooth finish on the surface of the concrete.

The above described conventional method of finishing concrete is labor intensive. Accordingly, it would be very desirable to provide an improved method for finishing concrete that would permit concrete to be finished in a substantially shorter period of time. It would also be desirable to provide a method that would permit concrete to be finished with a surface which is very level, and would produce a highly polished surface finish. Therefore, it is a principal object of the invention to provide an improved method and apparatus for finishing freshly poured concrete.

After concrete is initially laid, it must be worked while it is wet in order to provide a smooth, homogeneous mixture. Working the concrete helps settle the concrete and helps densify and compact the concrete during finishing. The working also removes air voids and brings excess water and fine aggregates to the surface for subsequent finishing. After the initial finishing stages are complete, a more detailed work frequently commences, generally by means of a handheld float to further compact the concrete for purposes including the driving of suspended gravel downwards. This floating help develop a wetted surface slurry or soup-like finish, while further driving out air pockets and the like for preparing the surface for final finishing. A bull float is most often used for this stage of compacting and smoothing the concrete. The bull float is a rectangular piece of material made from pinewood, magnesium or material other than iron or steel. (Iron "seals" concrete, which is not desirable during initial floating).

This floating is often accompanied by some sort of vibration of the concrete. In the above-described process, various large vibrating devices may be beneficially employed. Illustrative embodiments of such large vibrating tampers or the like may be seen in U.S. Pat. No. 3,306,174 to Wardell, U.S. Pat. No. 2,289,248 to Davis, U.S. Pat. No. 1,955,101 to Sloan, and U.S. Pat. No. 2,209,965 to Mall. These devices generally include a rather large flat base plate, a heavy and bulky vibratory mechanism disposed thereon, and an elongate handle attached thereto for moving the large plate across the concrete surface. Such devices are generally intended to provide a general smoothing and compacting operation over a large area.

After the concrete is floated, and a slurry forms, the surface of the concrete has a slight water sheen. The water sheen will evaporate from the surface of the concrete, leaving no apparent water sheen on the concrete surface. The speed of evaporation is dependent on ambient conditions such as temperature, humidity and exposure to wind or direct sunlight. It is at this point, i.e., when the water sheen has just disappeared from the concrete surface, that a "dry shake" hardener may be applied to the concrete.

In the related art, diverse attempts have been made to control and modify the characteristics including the surface characteristics of concrete flooring, road beds or the like with different types of additives. U.S. Pat. No. 4,746,788, to Shaw et al discloses a process for producing a concrete surface of seeded exposed aggregate using small, rounded aggregate (preferably sand) which is broadcast over the upper surface of the pour and thereafter mixed into the cement paste of the concrete pour matrix. A surface retarder and vapor barrier is applied for a short-term (approximately 4 to 24 hours) and removed and the concrete is thereafter cured by fogging or with a soaker hose and, after approximately 30 days, the surface residue is removed with a steam/acid wash to expose the finished floor.

Another method of producing a sand/cement upper surface is disclosed in U.S. Pat. No. 4,281,496, to Danielsson in which larger aggregate is allowed to settle, producing a thin upper layer formed substantially of sanded cement which is thereafter floated to remove surface irregularities. After curing 1 to 5 days, the upper surface is treated in a grinding operation to produce a flat, porous surface having a sanded quality.

Another technique involves the application of an excessively dry top dressing mix while the concrete base is still wet. Water rising from the base concrete penetrates into the topping and the two bond together. The top stratum of the conglomerate can then be wetted and floated to achieve a smooth finish. Such a system is shown by Sloan in U.S. Pat. No. 2,078,289. Reardon, in U.S. Pat. No. 2,853,928, discloses a method for curing concrete in which a dry powder composition is spread over the top of the wet concrete to absorb the excess moisture. The dry powder, however, is not blended into the concrete base and after the concrete is cured for a sufficient length of time, the dry powder is removed by vacuuming or sweeping. That composition is approximately 80 parts silica and about 20 parts salt. It is further known to apply a dry shake into a concrete base to control the concrete surface moisture. The dry shake may be incorporated to produce a monolithic cementitious floor by using various processes.

The American Concrete Institute (ACI) has approved an application procedure (No. 302) for adding a dry shake hardener to concrete. This procedure includes the following steps. Immediately after the slab surface has been floated, the first shake is applied in a uniform application by hand, spreader or other suitable method placing the material on the edges of the slab first. A mechanical spreader gives better results and is highly recommended. The first shake is allowed to remain unworked on the surface until it has absorbed moisture as evidenced by a change to a darker color. Then, it is floated with a hand or power float. Immediately after floating in the first shake, the second shake is applied, again placing the material on the edges of the slab first. The second shake is applied and floated in a like manner.

A problem with prior methods of finishing concrete is that moisture may evaporate quickly from the surface of the concrete such that there is not sufficient moisture to hydrate cementitious aggregates in dry shake hardener.

Another problem associated with prior methods of finishing concrete is that it is difficult to monitor and determine the time when the concrete surface has the optimum moisture content for application of dry shake hardener.

Another problem with prior methods of finishing concrete is that after excess moisture has evaporated from the surface of concrete, that one cannot add water to the surface during the finishing operation, or the surface layer may delaminate.

Another problem with prior methods of finishing concrete is that application of a dry shake hardener too late (i.e., when there is insufficient surface moisture) can cause delamination of the surface layer of the concrete.

Another problem with prior methods of finishing concrete is that application of dry shake hardener too early can cause the aggregates of the hardener to sink into the plastic concrete, causing a porous finish.

Another problem with prior methods of finishing concrete is that early application of dry shake hardener causes delamination, crazing, scaling and dusting on the surface layer of concrete.

Another problem with prior methods of finishing concrete is that during application of dry shake hardener, the hardener or colorant may not be properly mixed into the upper layer of concrete.

Another problem with prior methods of finishing concrete is that improperly applied dry shake hardener can cause uneven color in the concrete.

Another problem with prior methods of finishing concrete is that improperly applied dry shake hardener can cause uneven levels of hardening in the concrete.

Another problem with prior methods of finishing concrete is that bullfloating may not sufficiently consolidate, i.e., mix the dry shake hardener with the surface layer of the concrete.

Another problem with prior methods of finishing concrete is that when a dry shake hardener is not sufficiently consolidated with the surface layer of the concrete, that there is no smooth interface between the surface layer and the remainder of the concrete.

Another problem with prior methods of finishing concrete is that when the interface between the surface layer and the remainder of the concrete is not smooth, then the surface layer may delaminate at that interface.

After the conventional step of bullfloating the dry shake into the surface layer of the concrete, it is conventional to employ a smoothing or finishing trowel to develop a very smooth surface. It is also conventional to employ specialty tools (such as edgers) to provide finishing touches to the work (such as curved edges or the like) and steel trowels to seal the concrete. Flat steel troweling followed by raised steel troweling is used for typical finishing.

Prior methods of smoothing plastic concrete using a hand trowel are not effective in removing water or air pockets that may be trapped in the concrete. A simple hand trowel typically consists of a handle and a flat metal blade. The trowel is used to smooth the top layer of poured concrete, but has little effect on water or air below the surface of the concrete. Conventional hand trowels are also hard to use near walls or corners because they must be wiped back and forth over the surface of the plastic concrete and the wall often is an obstruction. Conventional hand trowels are also difficult to use for long periods of time because of the high amount of friction between the blade of the tool and the concrete.

Illustrative of the other types of finishing tools used at this stage is the power trowel. When the concrete has dried sufficiently to support the weight of an individual, i.e., when an adult can walk in a normal manner on the concrete without having his or her footsteps form depressions in the surface of the concrete, finishing with a power trowel may commence. The blades on a conventional power trowel are generally rotated at over one hundred rpm to overcome the frictional forces generated when the trowel blades move over the relatively dry surface of partially hardened concrete. The power trowel blades ride on and smooth the surface of the concrete and three or four passes of a power trowel over the entire surface of a slab of concrete are ordinarily required to properly finish the concrete. The power trowels ordinarily weigh at least one hundred and twenty pounds.

Alternatively, when the work has progressed to the finishing stage wherein it is desired to provide a highly smoothed surface finish, a variety of prior vibrating hand trowels have been employed with varying degrees of success. Representative examples of such trowels that are primarily for smoothing or finishing work may be seen in U.S. Pat. No. 3,376,798 to Bodine, U.S. Pat. No. 2,514,626 to Clipson, and U.S. Pat. No. 2,411,317 to Day et al. Whereas such trowels are, in contrast to the aforementioned larger devices, intended for hand-held operation, they retain several characteristics of the larger devices such as being of a rather awkward, large and heavy construction. In a hand-held tool this bulk, weight, and complexity may render the tool totally impractical for use, particularly in view of the fact that the operator is typically working for long periods of time on his knees and often in awkward positions.

It must be recognized that these trowels are conventionally used primarily in the finishing operations wherein a great deal of vibratory energy is not required inasmuch as a mere final smoothing of the surface slurry is being effected. Notwithstanding, a variety of such vibrating means have been attempted to be employed including plunger-type vibrators (as disclosed in the patent to Clipson), air driven turbine vibrators (as disclosed in the patent to Day), and even sonic air-driven orbiting-mass type vibrators (as illustrated in the patent to Bodine).

Another prior vibrating hand trowel is disclosed in U.S. Pat. No. 5,234,283 to Adkins. In this trowel the vibratory mechanism is mounted inside the handle. The vibratory mechanism vibrates a rigid metal blade of relatively large mass by "pushing off" of the handle in an oscillating fashion. An inherent consequence of this construction is that the handle vibrates as much or more than the blade of the trowel that contacts the wet concrete. These vibrations cause discomfort and difficulty of use for the operator. As a means of reducing the amount of uncomfortable vibrations transmitted through the handle to the operator, this device, in practice, is typically manufactured such that the handle/vibrator mechanism is of relatively high mass. Also, because only one vibrating mechanism (i.e. located in the handle and attached to the blade of the trowel at one point) is used to drive the entire blade, the blade must be constructed of particularly rigid, (and therefore frequently heavy and thick) material in order to cause the entire blade to vibrate in phase. As discussed above with respect to other prior vibrating finishing tools, it is undesirable for such tools to be heavy and bulky. Heavier tools may sink into the concrete causing depressions in the surface because the working surface of the tool applies too much pressure to the concrete surface.

A more desirable finishing tool would incorporate characteristics that would cause the majority of the vibratory energy to be transmitted to the work concrete through the bottom of the device in an efficient and uniform manner and not to the operator through the handle. It is also desirable that the ratio between a finishing tool's weight and its working surface's area be low so as not to cause depressions in the surface of the concrete.

A problem with prior methods of finishing concrete with prior finishing tools is that they are not effective in removing water or air pockets that may be trapped in the concrete.

Another problem with prior methods of finishing concrete with prior finishing tools is they are difficult to use for long periods of time because of the high amount of friction between the blade of the tool and the concrete.

Another problem with prior methods of finishing concrete with prior finishing tools is bulk, weight, and complexity may render the tool totally impractical for use.

Another problem with prior methods of finishing concrete with prior finishing tools is the handle vibrates as much or more than the blade of the finishing tool causing discomfort and difficulty of use for the operator.

Another problem with prior methods of finishing concrete with prior vibrational finishing tools is that t he weight of the vibrating mechanism causes the tool to sink into the concrete causing depressions in the surface of the concrete.

Another problem with prior methods of finishing concrete with prior power trowels is the weight of the power trowel increases the wear on the trowel blades.

Another problem with prior methods of finishing concrete with prior finishing devices is the weight of the device creates new depressions in the surface of the concrete.

Another problem with prior methods of finishing concrete with prior finishing tools is that they redistribute the upper layer of the concrete causing "waves" on the surface of the concrete from the alternating depressed and raised areas.

Another problem with prior methods of finishing concrete with prior finishing tools is that lighter tools do not vibrate sufficiently to removes the "waves" in the surface of the concrete.

SUMMARY OF THE INVENTION

The present invention generally relates to a method of advantageously finishing an exposed surface of a plastic concrete mass using a dry shake hardener in conjunction with a vibrating finishing tool. The finishing tool together with a dry shake hardener may be used to modify the texture or character (i.e. the "finish") of a surface of the concrete. A dry shake hardener may be consolidated with a slurry formed on the surface of a plastic concrete mixture more readily when the dry shake hardener is vibrated together with the slurry. The following disclosure also describes the preferred embodiment of the vibrating finishing tool used in that method.

The vibratory action of the finishing tool is generated by one or more piezoelectric actuators which, when energized vibrate at a selected frequency. In the preferred embodiment of the invention, the vibrations are transferred through a blade at the bottom of the finishing tool and into the plastic concrete. This vibration causes air and water to rise to the surface of the concrete creating a layer of moisture on the surface of the concrete. This moisture also advantageously lubricates the working surface of the finishing tool, making for easier use, and creates a slurry which is desirable for producing a smooth surface finish. The moisture is also advantageously absorbed by the dry shake hardener and worked into the upper layer of the concrete. The vibrations are at such a high frequency and the displacement of the bottom surface of the finishing tool is so small that the operator can barely feel the vibrations through the tool's handle. This, coupled with the lightweight design and other characteristics described herein below, makes the finishing tool very easy to handle and operate.

Accordingly, it is a primary object of the present invention to provide a method of finishing the surface of plastic concrete which includes the step of vibrating the concrete with a vibrating finishing tool.

It is another object of the present invention to provide a lightweight, energy efficient, piezoelectrically actuated vibrating surface finishing tool for the step of vibrating the concrete.

It is another object of the present invention to provide hand-operated concrete/cement working tools of an automatically vibrating variety wherein a substantial vibratory energy is imparted to the concrete surface.

It is another object of the present invention to provide a device that is effective in creating a smooth and wet top layer in the plastic concrete for lubrication of the tool and a smooth finish of the concrete.

It is another object of the present invention to provide a device of the character described in which the piezoelectric element(s) is(are) protected from damage within a sealed interior chamber.

It is another object to provide a modification of the present invention in which the vibratory energy is imparted into the concrete in the frequency range of 50 to 500 hertz.

It is another object to provide a modification of the present invention in which the frequency of vibration is easily user-modified.

It is another object of the present invention to provide a device of the character described that is battery powered.

It is another object of the present invention to provide a device of the character described that makes trapped water and air in a concrete mixture rise to the surface of the concrete.

It is another object of the present invention to provide a method and device of the character described in which released moisture is used to hydrate a dry shake hardener or colorant.

It is another object of the present invention to provide a method and device of the character described that consolidates a dry shake into the surface layer of concrete.

It is another object of the present invention to provide a method and device of the character described that consolidates a dry shake into the surface layer of concrete faster and easier than conventional techniques.

It is another object of the present invention to provide a method and device of the character described in which the surface layer of concrete is smoothed and flattened.

It is another object of the present invention to provide a method and device of the character described in which the surface layer of concrete is smoothed and flattened simultaneously with the consolidation of a dry shake into the concrete.

Further objects and advantages of this invention will become apparent from a consideration of the drawings and ensuing description thereof.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DESCRIPTION OF THE PREFERRED EMBODIMENTS

Figure 1:
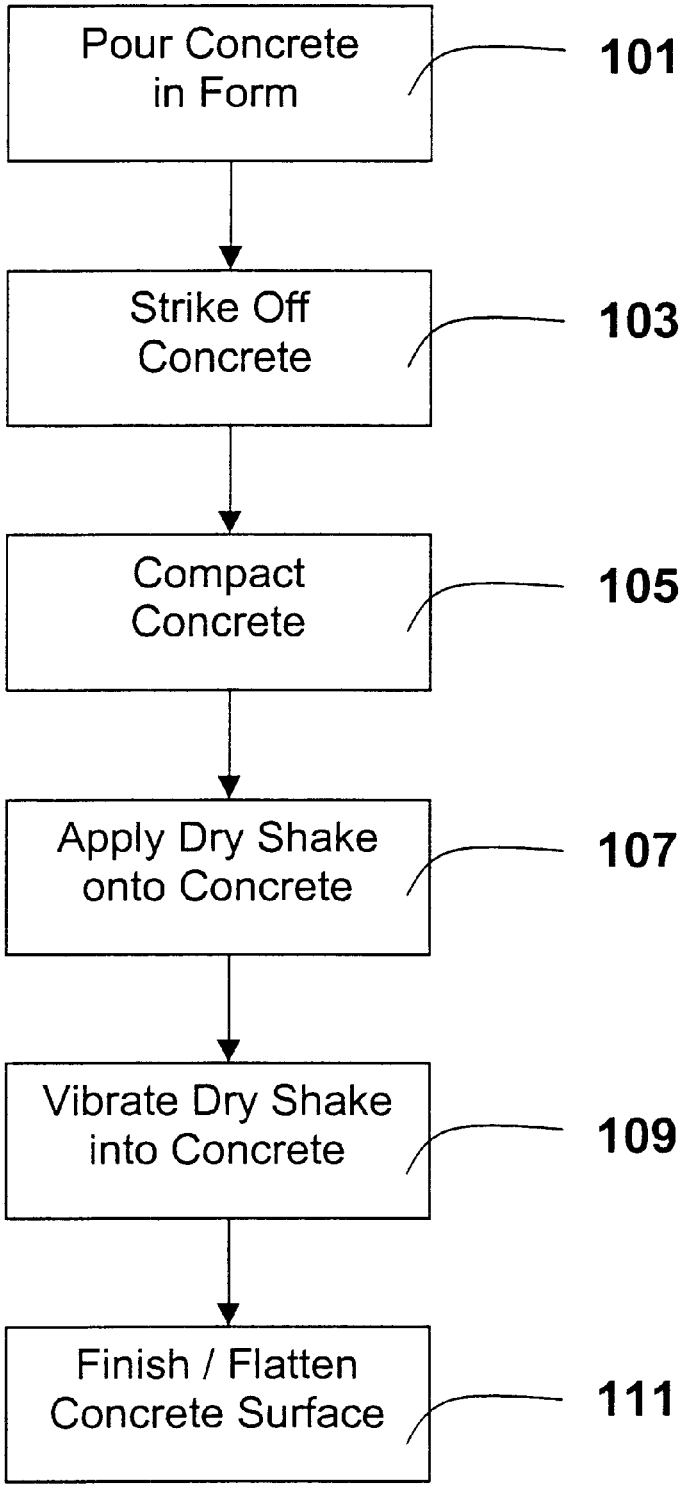
FIG. 1 is a schematic flow diagram showing a method of finishing a concrete mass according to the present invention.

As will be described hereinbelow, the present invention is a method including an apparatus for "finishing" concrete slabs (and related structures) in which vibrational energy is imparted into an uncured, plastic concrete mass M. This method includes the steps of first pouring 101 fresh concrete into a form and then striking off 103 the concrete to a first profile. After striking off 103, the still fresh and plastic concrete is compacted 105 using a float or similar device. After the initial compaction 105, a dry shake hardener is applied 107 to the concrete, and a vibrating finishing tool is used to vibrate 109 the hardener and concrete, working the hardener into the upper layer of the concrete. After the hardener has been worked into the upper surface layer of the concrete using vibration 109, the concrete is then finished 111 with a finishing tool, which may be the same vibrational finishing tool used in the vibration step 109.

Figure 2:
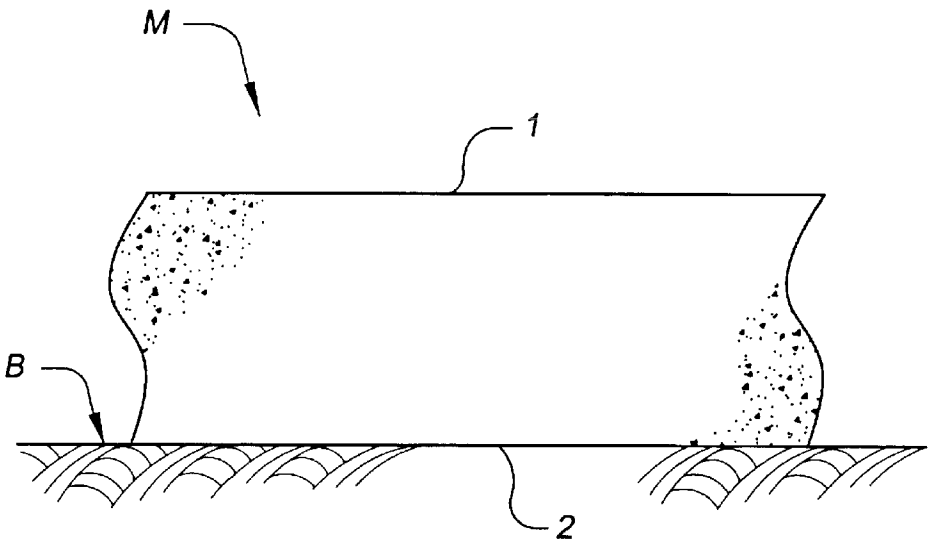
FIG. 2 is a schematic cross-sectional elevation illustrating a concrete slab under construction immediately after the concrete mass has been poured.

Referring to FIG. 2, when the concrete mass M is initially poured, it is actually a mixture of solids (including cement, aggregates, etc.) and liquid (primarily water). The initially-poured concrete mass predominantly exhibits liquid-like properties and thus may be characterized as being a liquid. FIG. 2 of the drawings illustrates a concrete mass (generally indicated "M" in the figures) which may be in the form of a slab of concrete that has been poured 101 into a form (not shown) or the like from any suitable source onto a slab sub-base B. The concrete mass M typically includes aggregate, cement, water and other additives which may conventionally be employed in concrete slabs.

When the concrete mass M is initially poured 101, the aggregate, cement, water and other materials incorporated into the concrete are typically randomly distributed throughout the thickness of the concrete mass M between the sub-base B and the exposed top surface 1 of the concrete slab. At the instant at which the concrete mass M is first poured 101, virtually none of the concrete mass is sufficiently consolidated, firm and dry enough for purposes of finishing the top surface 1 of the slab. (In this context, the word "finishing" is a term of art that refers to the way in which the surface of a concrete slab is smoothed.)

Also, at the instant at which the concrete mass M is first poured 101, there typically exist variations in the moisture content and the degree of consolidation of the concrete mass M from one point to another over the entire volume of the concrete mass M.

When concrete slabs (and similar structures) are placed, it is conventional practice to employ a concrete mass which initially has far more moisture content, is far less consolidated, and is far less firm than that which is necessary to begin finishing operations. These properties are initially desirable when placing a concrete structure because they render the concrete mass much more "liquid-like" and workable than would otherwise be the case. In addition, the initial surplus of water in the concrete mass has the effect of preventing or retarding the (undesirable) premature curing of the concrete mass As indicated by the irregular line 50 in FIG. 3, at the instant at which the concrete mass is first poured, the firmness of the concrete mass may vary somewhat from the top of the slab to the bottom, but on average it is virtually constant from the bottom of the slab to the top.

Figure 3:
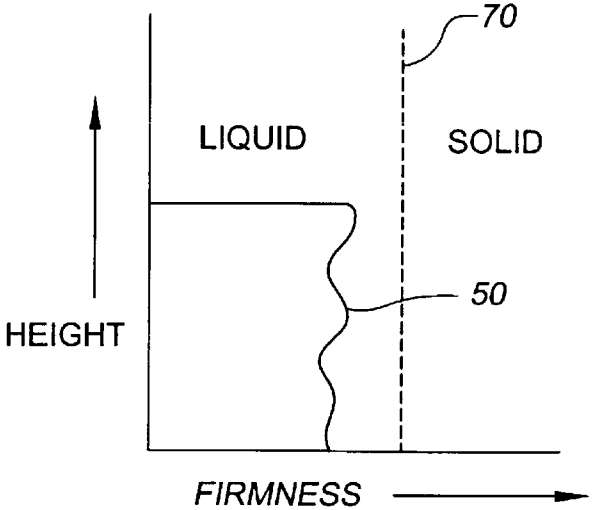
FIG. 3 is a graph which plots the firmness profile of the concrete slab of FIG. 2.
Figure 5:
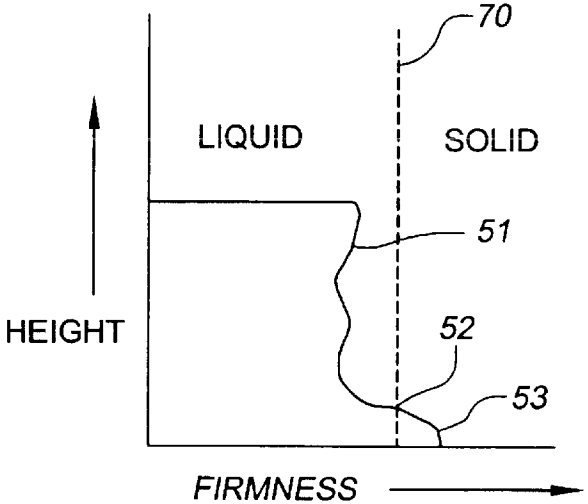
FIG. 5 is a graph which plots the firmness profile of the concrete slab of FIG. 4.
Figure 7:
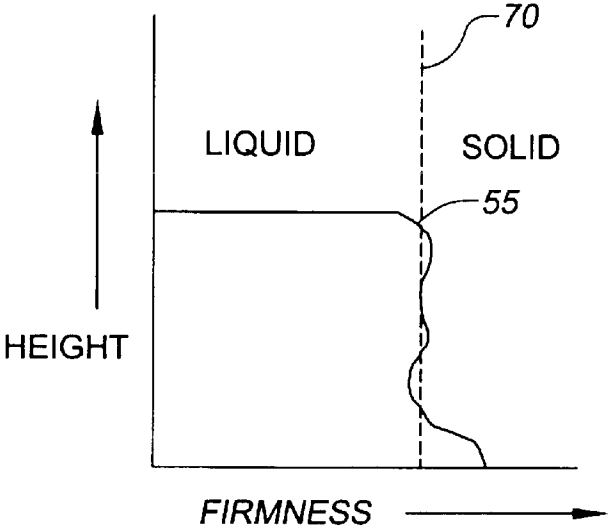
FIG. 7 is a graph which plots the firmness profile of the concrete slab of FIG. 5.

Line 70 represents a value of constant firmness in FIGS. 3, 5 and 7, and is representative of the minimum value of "firmness" of the concrete mass which is desirable to be obtained before commencing finishing operations. Also, as discussed previously (above), line 70 generally corresponds to a degree of "firmness" to the right of which the concrete mass may be characterized as acting more like a solid, and to the left of which the concrete mass may be characterized as acting more like a liquid. As indicated in FIG. 3, at the instant at which the concrete mass is first poured, the entire concrete mass is less firm than the minimum desirable value, represented by line 70.

After the overly moist, "liquid-like" concrete mass is poured 101 into place it is roughly brought to the desired depth and shape of the slab. This is accomplished in the step of screeding or striking off 103, i.e., spreading, distributing, smoothing and/or leveling the uncured concrete, with or without the use of prepositioned guides or rails. In the concrete placement industry, numerous methods and techniques for spreading and leveling the concrete are available. These include passing an edge of a two by four plank across the top of the concrete as well as more sophisticated power screeds such as large rail or guide supported screeds and slip-form pavers. Such machines run on wheels or tracks and follow guide lines or strings such that a concrete strip is laid and leveled on a desired path.

Figure 4:
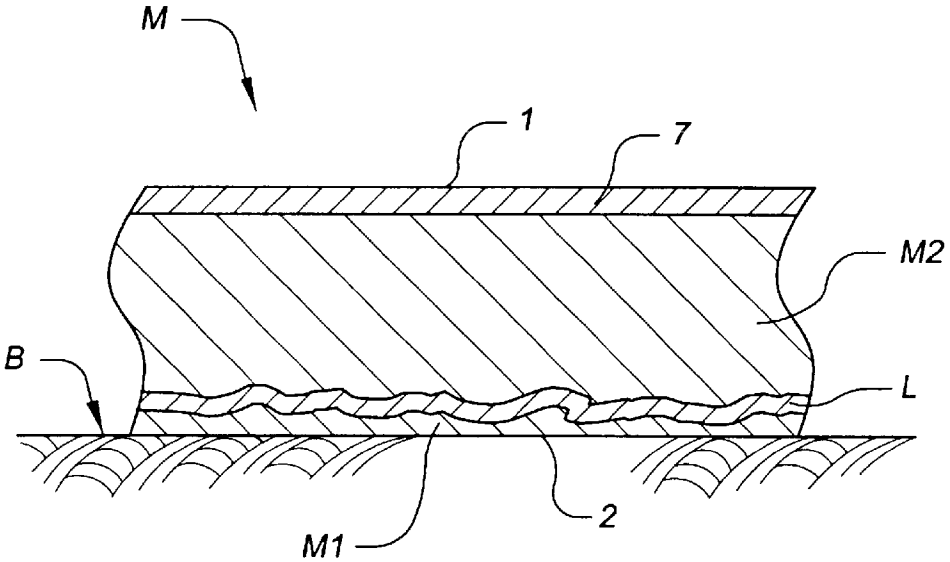
FIG. 4 is a schematic cross-sectional elevation of the concrete slab of FIG. 2 shown a short time after the concrete mass has been poured, prior to vibration of the concrete mass.

Referring now to FIG. 4: After the concrete mass M has been poured 101 onto the sub-base B into the form of a slab and has been struck off 103, the weight of the aggregates (not shown) which comprise the concrete mass naturally push downward toward the sub-base B. The aggregates, being of relatively high density, begin to squeeze water and entrapped air out of the concrete mass M. Because there is more pressure near the bottom 2 of the slab than near the top 1 of the slab, more of the water and entrapped air is initially squeezed out of the concrete mass near the bottom 2 of the slab than near the top 1 of the slab, thus resulting in relatively more consolidated, relatively more firm and relatively drier concrete M1 near the bottom 2 of the slab, and relatively less consolidated, relatively less firm and relatively less dry concrete M2 nearer the top 1 of the slab.

FIG. 5 is a graph illustrating a typical profile firmness gradient between the top and the bottom of the slab after the concrete mass M is initially poured 101 and natural de-watering has begun. As illustrated in FIG. 5, after natural de-watering has begun, the firmness of the concrete mass is generally greater nearer the bottom of the slab (as indicated by line segment 53) and is generally less nearer the top of the slab (as indicated by line segment 51). Between line segment 51 and line segment 53 is a relatively more flat line segment 52 which corresponds to a transition zone L between the relatively more firm concrete mass M1 nearer the bottom of the slab 2 and the relatively less firm concrete mass M2 nearer the top of the slab 1. As natural dewatering occurs, the concrete mass M including the surface layer 7 becomes firmer on the average.

When the concrete mass M has dewatered sufficiently to create a somewhat firm upper surface layer 7, the concrete is then floated 105 using a bullfloat or darby, further leveling and compacting the concrete mass M. Floating 105 should occur before any water bleeds to the surface 1 of the concrete. If bleed water has appeared, it should be removed by dragging the surface 1 with burlap or a rubber hose.

Floating 105 the concrete helps further settle the concrete aggregates and helps to densify and compact the concrete. Floating 105 also helps further remove air voids and bring excess water and fine aggregates to the surface 1 for subsequent finishing. Floating 105 also serves purposes of driving of suspended gravel downwards, and developing a wetted surface layer 7 (i.e., a slurry or soup-like finish) for preparing the surface 1 for final finishing. The wetted slurry 7 is a more porous "open" surface than the final finished surface, and is amenable to application of additives such as colorants and hardeners. This is because in a porous surface layer 7 capillary action allows the additives to combine more readily with the slurry.

A bull float is most often used for this stage of compacting 105 the concrete. The bull float is a large rectangular piece of material made from pine wood, magnesium or material other than iron or steel. (Iron "seals" concrete, which is not desirable during initial bull floating 105). Earlier floating 105 of the slab edges by hand is strongly recommended since the edges generally dry first. This floating 105 is often accompanied by some sort of vibration of the concrete. Various large vibrating devices may be beneficially employed to provide a general smoothing and compacting operation over a large area. Illustrative embodiments of such large vibrating tampers may be seen in U.S. Pat. No. 3,306,174 to Wardell, U.S. Pat. No. 2,289,248 to Davis, U.S. Pat. No. 1,955,101 to Sloan, and U.S. Pat. No. 2,209,965 to Mall. These devices generally include a rather large flat base plate, a heavy and bulky vibratory mechanism disposed thereon, and an elongate handle attached thereto for moving the large plate across the concrete surface.

Figure 6:
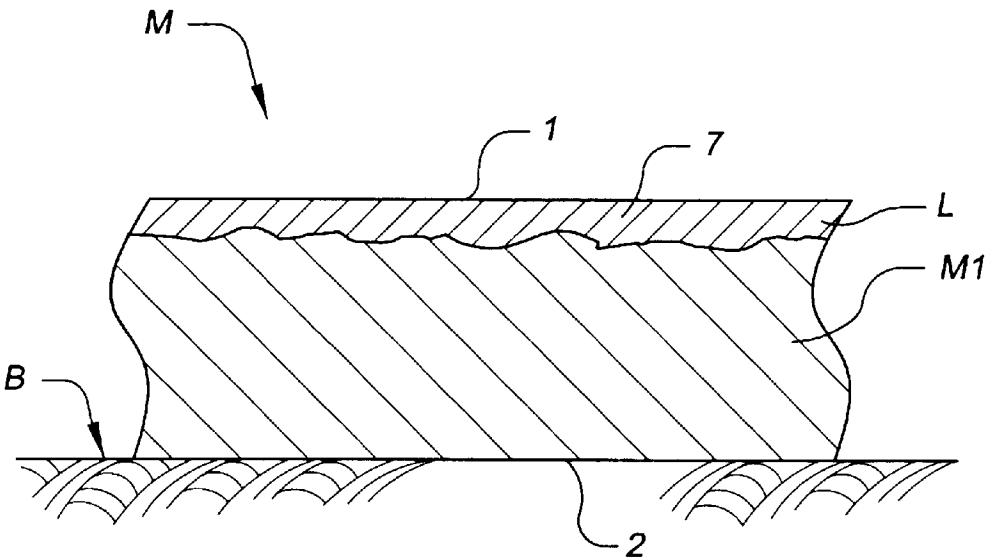
FIG. 6 is a schematic cross-sectional elevation of the concrete slab of FIG. 1 shown during the vibration step of the present invention.

After the concrete has been floated 105, and a slurry has formed, the surface 1 of the concrete has a slight water sheen. Depending on ambient conditions, the water sheen will evaporate from the surface 1, leaving no apparent water sheen on the concrete surface 1. The surface layer 7 of the concrete should have stiffened to the point of supporting further floating operations. Normally, a finisher's footprint of ¼" to ⅜" (6.4–9.5 mm) in depth indicates that the slab M is ready for floating. FIGS. 6 and 7 illustrate the firmness profile of the concrete when the concrete may support further floating operations. When the concrete slab M has this firmness profile, as illustrated in FIG. 7, the surface layer 7 coincides with the transition layer L and is at a transition point between liquid and solid, as indicated by line segment 55 which is distributed equally on both sides of line 70.

When the surface layer 7 of the concrete has stiffened to a point where the consistency is at the solid-liquid transition and the water sheen has just disappeared from the concrete surface, a "dry shake" hardener may be applied 107 to the concrete. "Dry Shake Floor Hardeners" are additives formulated to be added to concrete mixtures. Dry shake hardeners are most often used for heavy duty industrial floors subject to wet and aggressive environments and severe traffic, continuous abrasion, wear, and impact. Primary applications include industrial floors, aircraft hangars, basements and cellars, mechanical workshops and maintenance areas, corridors and halls, parking areas, narrow high-stack vehicular traffic routes, tractor and automotive plants, and loading, shipping, and receiving areas. Representative of dry shake hardeners are MASTERTOP™ 100 Dry Shake Floor Hardener manufactured by Master Builders, Inc. of Cleveland, Ohio and FERROCON™ FF, Non-Oxidizing Iron Aggregate, Dry Shake Surface Hardener manufactured by L&M Construction Chemicals, Inc. of Omaha, Nebr.

Dry shake hardeners are typically applied to concrete on a well compacted, leveled sub-grade. Furthermore, the concrete should be non-air entrained, i.e., air content must be below 3%. Calcium chloride or admixtures containing more than 0.05% chloride ions are not permitted for metallic dry shakes. When the surface layer 7 of the concrete is at its solid-liquid transition point, the dry shake hardener should be applied 107 in a uniform application by hand, spreader or other suitable method. A mechanical spreader gives the best results and is highly recommended. The standard application rate of dry shake hardener is 5 to 15 kg/square meter (1 to 3 lbs/sq. ft.). Some dry shake hardeners are specifically developed to be applied at heavier application rates, up to 10 kg/square meter (2 lbs/sq. ft.), in a single application step within minutes after screeding 103 and floating 105. These dry shake hardeners also allow for higher application rates to achieve greater floor thickness for increased wear resistance in severe wear areas. The higher the application rate is the better the abrasion and impact resistance.

When the dry shake hardener is applied 107, there should be sufficient moisture remaining in the surface layer 7 of the concrete to hydrate cement binders in the dry shake (after excess bleed water/water sheen has evaporated or been removed). The dry shake hardener should not be applied 107 when there is excess bleed water on the surface 1 because the binders in the hardener will hydrate. Hydration of the binders seals the concrete surface 1, which will not allow water to further bleed through the surface layer 7 of the concrete. Excess water trapped within the concrete can cause delamination of the surface layer 7 of the concrete.

Typically, the application 107 of the dry shake hardener is in two parts, using two thirds of the dry shake on the first part of the application 107, and the remaining third in the second part of the application 107. Approximately two thirds of the hardener should be evenly distributed 107 over the surface 1 of the concrete at which point the hardener should start to darken from absorbing the moisture in the surface layer 7 of the concrete. Absorption of the moisture hydrates the cementitious binders in the dry shake.

The hardener should be applied 107 to concrete mixes at temperatures of between 60° F. (16° C.) and 80° F. (27° C.). Depending on ambient conditions (air temperature, wind, etc.) surface evaporation may happen very quickly, not leaving sufficient moisture in the surface layer 7 of the concrete. Unusual conditions, such as direct hot sun, high winds, low humidity or cold weather usually require the exercise of care to protect the slab during dry shake placement. Under these conditions, it is recommended that the building's roof and walls or wind screens be in place and the slab protected from the direct environment. This is generally not practical and because of these conditions it is sometimes difficult however to determine whether sufficient moisture is remaining in the surface layer 7 of the concrete. To counter unusual ambient conditions, the dry shake is sometimes placed onto plastic, fresh concrete earlier than normally recommended, which may lead to a poor surface finish. If the aggregates in the hardener break through the surface when being applied 107, the concrete is still too plastic for application 107 of the dry shake, which will lead to poor surface finish.

If the surface layer 7 of the concrete has stiffened beyond the solid-liquid transition point, very little moisture remains in 11 the surface layer 7 of the concrete. In situations where there is insufficient surface moisture, conventional floating operations may not sufficiently consolidate the hardener with the surface layer 7 of the concrete. Furthermore, the cementitious binders in the hardener may not achieve complete hydration. When the dry shake hardener is not completely hydrated or is insufficiently consolidated with the surface layer 7 of the concrete, the surface layer 7 of the concrete will later delaminate. This occurs in part because the interface between the surface layer 7 and the concrete below the surface layer 7 has a distinct boundary, which makes the surface layer 7 more susceptible to delamination. When the concrete is properly consolidated, the interface between the surface layer 7 and the underlying concrete is more gradual and has a more even distribution of aggregates, which is not as susceptible to delamination. In the present finishing method, a vibrating finishing tool 20 is used to consolidate 109 the dry shake and the surface layer 7 of the concrete. This vibration helps to eliminate the problems associated with insufficient moisture and improper consolidation in the surface layer 7 of the concrete.

After the dry shake hardener has been applied 107 to the concrete surface 1, the hardener is vibrated 109 into the surface layer 7 of the concrete. Specifically, when the dry shake material darkens slightly from absorbed moisture, the surface layer 7 of the concrete is vibrated 109 with the vibrating finishing tool 20. The finishing tool 20 is pushed and pulled along the surface 1 of the concrete, and this motion in conjunction with the tool's vibration 109 allows the hardener to be mixed and consolidated with the surface layer 7 of the concrete.

Even when there is not sufficient moisture on the surface layer 7 of the concrete to darken the dry shake additive, the disclosed vibrating finishing tool 20 causes water to migrate from within the concrete mass M to the surface layer 7 of the concrete. This upward migration of water creates a surface layer 7 that is at the solid-liquid transition point, which is the appropriate level of firmness for consolidation with the dry shake. Using the vibrating finishing tool 20 in this way allows moisture from the surface layer 20 of the concrete to be worked completely through the hardener.

Little attention is given in the prior art to the importance of determination of the frequency at which vibrations should be applied 109 to the work material. Thus prior vibrating concrete finishing tools typically are not provided with means by which tools vibration frequencies can be readily changed by the user. Consequently, many prior devices do not vibrate 109 the concrete very efficiently. Most prior concrete finishing vibrating finishing tools are operated simply by turning a switch having only two settings: on or off. However, in practice different regions of the concrete as well as different batches of concrete differ in level of moisture, and consequently degrees of solidity or liquidity. A different frequency of vibration may be required from one batch to another, or even between different areas of a slab, in order to cause the desired upward migration of air and water, as well as to consolidate the concrete (and dry shake material) more quickly and more efficiently.

In the present invention, the vibrational finishing tool 20 is provided with means to adjust the frequency of the vibration of the concrete surface layer 7. It has been observed that the rate of upward migration of air and moisture in the concrete depends on the frequency of vibration applied to the concrete. This is because the natural frequency of each batch may be different due to the amount of water, concrete and aggregate mix that make up each particular batch.

The ease of operation of the finishing tool 20 relates not only to the surface characteristics of the concrete, but also the amount of moisture which has migrated to the surface 1 of the concrete. In addition, it has also been noted that the ease of operation of the finishing tool 20 is affected by the finishing tool's low weight as well as by the frequency of vibration of the finishing tool 20. Thus, pulling and pushing the tool 20 across the surface 1 of the concrete may be made easier by adjusting the frequency of vibration of the finishing tool 20 by adjusting the frequency of the voltage applied to the vibrating elements of the tool. The vibration of the finishing tool 20 in turn causes more moisture to migrate toward the surface 1. The moisture on the surface creates a slurry which may further facilitate the pulling and pushing of the finishing tool 20 across the surface 1 of the concrete as well as the consolidation of the dry shake material with the surface layer 7 of the concrete.

Once the moisture from the surface layer 7 of the concrete has been worked completely through the first two thirds of the hardener, then the remaining one third of the hardener may be applied 107. The remaining third of the hardener should be applied 107 perpendicular to the direction of the first application (i.e., the predominant direction of mechanical spreading or hand broadcasting). The moisture from the surface layer 7 of the concrete again must be completely worked through the hardener. If this does not occur, the floor surface may delaminate. Care should also be taken not to tear through the surface layer 7 of the concrete into the underlying concrete.

Again, if there is still insufficient moisture in the surface layer 7 to darken the dry shake, the vibration of the finishing tool 20 will cause upward migration of moisture into the surface layer 7. This upward migration of moisture will create a surface layer 7 in a solid-liquid transition that contains sufficient moisture to hydrate the binders in the dry shake hardener. The vibration of the finishing tool 20 as well as the pushing and pulling of the vibrational finishing tool 20 across the surface 1 of the concrete will consolidate the dry shake hardener with the surface layer 7 of the concrete.

Upon completion of the vibration/consolidation 109 step, the concrete should then be finished 111. Finishing 111 is the final step of making the surface 1 completely free of bumps or waves, and providing the appropriate surface texture. Finishing 111 may be accomplished with a vibrating finishing tool 20, or with conventional finishing tools, such as hand trowels or power trowels or any combination of these finishing tools. The finishing tool provides a final smoothing of the surface with one or more steel trowel blades, which "seals" the concrete. The finishing tool is drawn across the concrete surface 1 redistributing the surface layer 7 in order to rid the surface 1 of waves or bumps, to produce as level and as flat a surface 1 as possible. The provision of the final surface texture may be accomplished simultaneously with troweling 111 (which provides a smooth finish) or the surface may be provided with a rougher more abrasive texture (i.e., broom finished).

Finishing Tool

Figure 8:
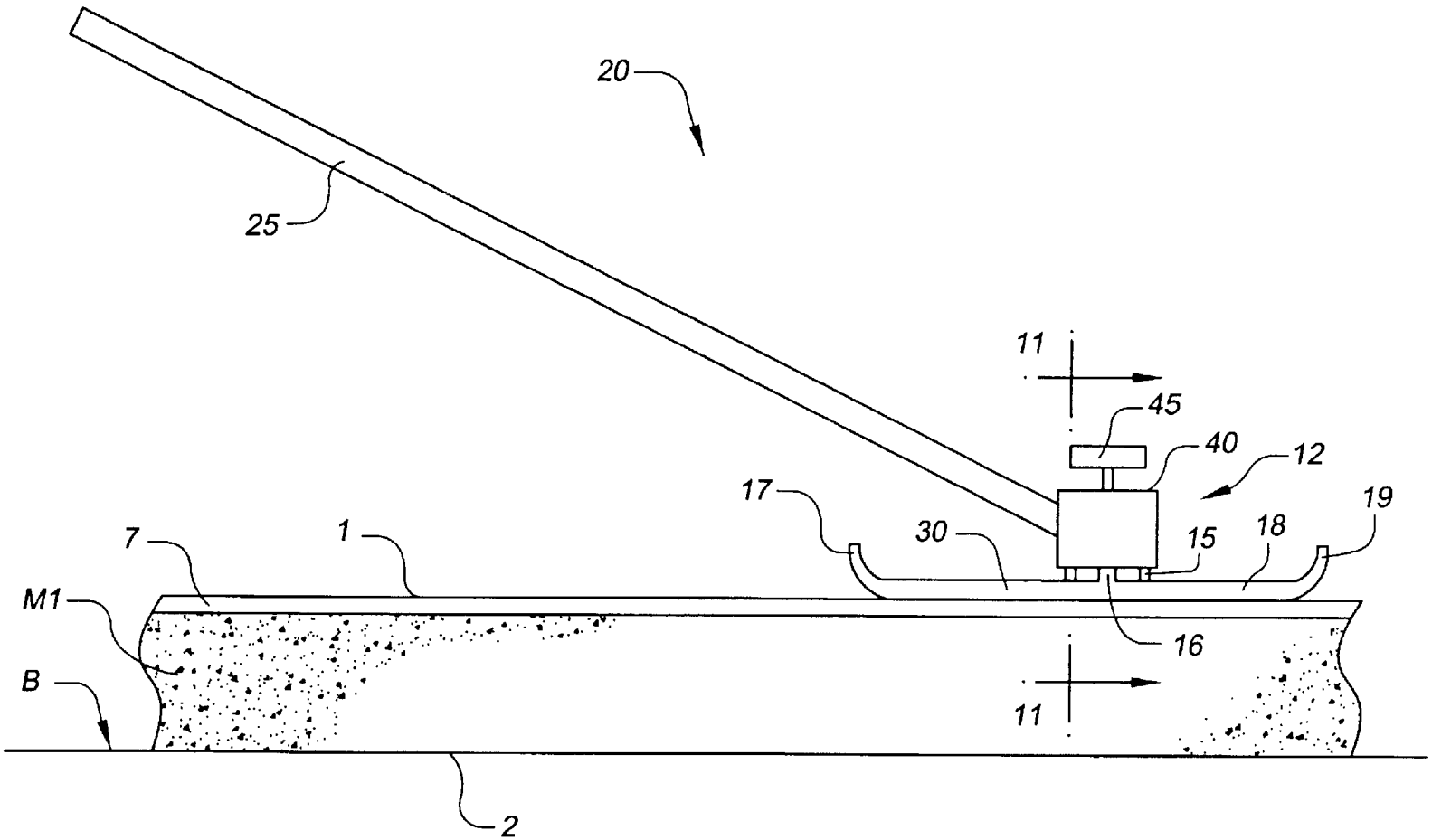
FIG. 8 is a side elevation showing the construction of a finishing tool used in the vibration step of the present invention.
Figure 9:
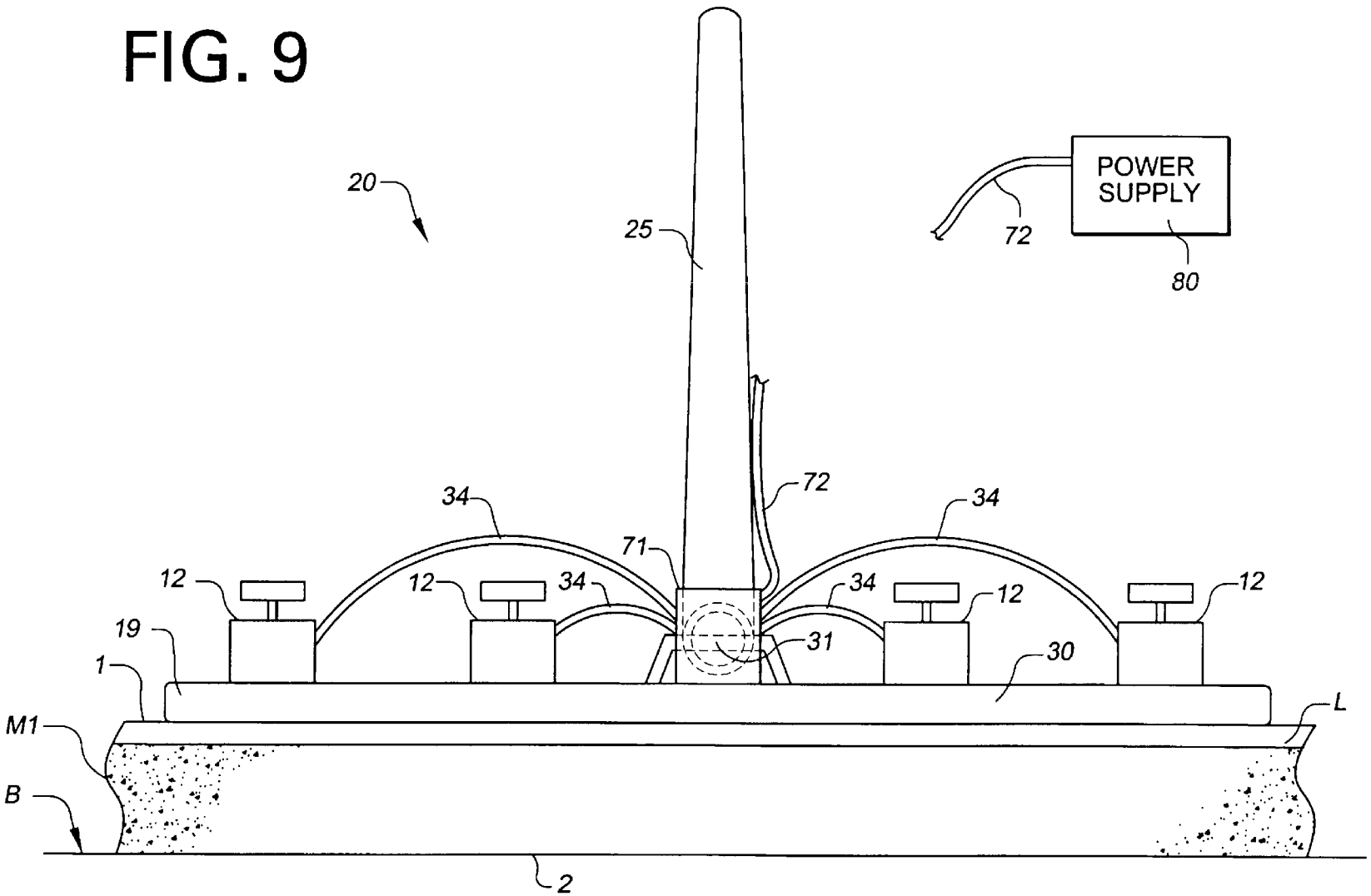
FIG. 9 is a front elevation showing the construction of a finishing tool used in the vibration step of the present invention.

With reference directed toward FIGS. 8 and 9 of the appended drawings, a piezoelectrically actuated vibrating finishing tool embodying the principles and concepts of the present invention and generally designated by the reference numeral 20 will be described. In the preferred embodiment of the invention, the vibrating finishing tool comprises a float 20 with a blade 30 that is vibrated using one or more piezoelectric actuators 12. The float 20 comprises a blade 30 with a bottom surface that is substantially flat and suitable to engage the surface 1 of plastic concrete for floating operations. Representative of appropriate blades 30 is a flat rectangular plate 18 with a width of eighteen inches and a length of forty-eight inches. The blade 30 is made of a light, rigid material preferably aluminum. Rigidity and stiffening of the blade 30 may be enhanced by a rib 16 running centrally along the length (i.e., longitudinally) of top surface of the plate 18. The front and rear edges 17 and 19 of the plate 18 may be rounded to prevent the edges 17 and 19 from digging into and leaving marks in the surface 1 of the concrete when operating the float. The float blade 30 is attached to an elongate handle 25 at an attachment point 31 (shown in ghost behind distribution box 71) which may provide either a pivotable coupling or a rigid coupling between the handle 25 and the float blade 30.

Vibratory actuators 12 are attached to the float blade with conventional attachment means such as screws or bolts 15, or welding or the like. The actuators 12 may be attached directly to the float blade 30, or to the rib 16 or both. A single actuator 12 centrally attached to the float blade 30 may be used to vibrate the float blade 30. However, in the preferred embodiment of the vibrating finishing tool 20 an even number of evenly longitudinally spaced out actuators 12 are attached to the float blade 30. In the embodiment illustrated in FIG. 9, four actuators 12 are attached to the top side of the float blade 30 along a longitudinal axis A, with two actuators 12 on either side of the handle attachment point 31. This configuration for attachment of the actuators 12 allows the actuators 12 to impart vibratory energy to both the ends of the float blade 30 as well as areas of the float blade 30 closer to the central attachment point 31.

Figure 11:
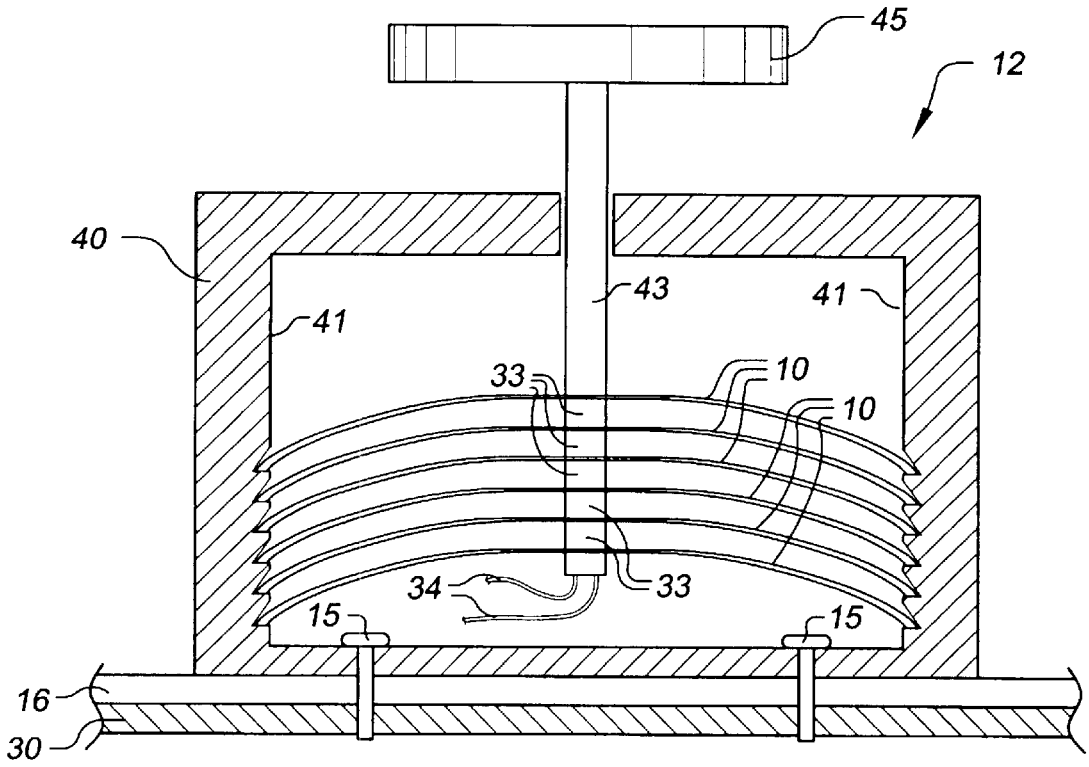
FIG. 11 is a cross sectional view along line 11—11 of FIG. 8 showing the construction of a piezoelectric actuator used to vibrate the finishing tool.
Figure 12:
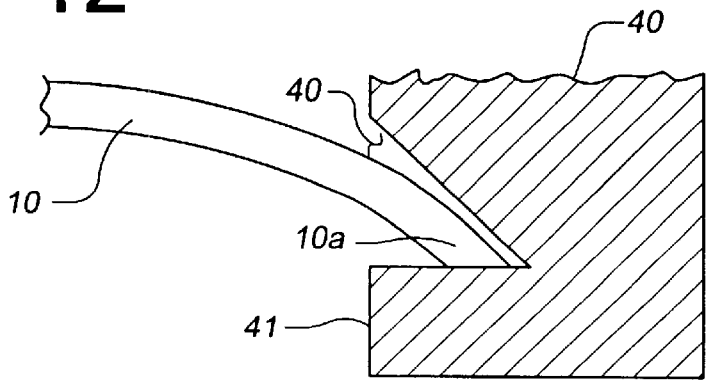
FIG. 12 is a detail of an edge of a piezoelectric element in a groove of the actuator in FIG. 11.

With reference to FIG. 11: In the preferred embodiment of the invention, a piezoelectric actuator 12 is used to vibrate the float blade 30 of the vibrating finishing tool 20. The piezoelectric actuator 12 comprises a housing 40 with an interior surface 41. In the interior surface 41 of the housing 40 is a series of grooves 42 adapted to receive the edges 10*a* of one or more piezoelectric vibrating elements 10.

The piezoelectric vibrating element 10 is a flextensional piezoelectric transducer. Various constructions of flextensional piezoelectric transducers may be used (including, for example, "moonies", "rainbows", and other unimorph, bimorph, multimorph or monomorph devices, but preferably comprise Thin Layer Unimorph Driver and Sensor ("THUNDERS™") actuators. The THUNDER™ piezoelectric vibrating elements 10 are manufactured by Face International Corporation of Norfolk, Va. and are described in U.S. Pat. No. 5,471,721, hereby incorporated by reference.

The THUNDER™ piezoelectric vibrating elements 10 are mechanically prestressed and thus assume a curved shape. The series of grooves 42 in the housing 40 preferably receive the edges 10*a* of several piezoelectric elements 10 that are in a stacked configuration (i.e., "nested" with their concave faces all facing the same direction).

In the stacked configuration of the piezoelectric vibrating elements 10, each individual piezoelectric vibrating element 10 is separated from the next by a spacer 32. The spacer 32 may simply act as a device to separate one piezoelectric vibrating element 10 from another, but preferably each spacer comprises an electrical contact plate 33. Electrical contact plates 33 may be bolted together to secure a stack of piezoelectric vibrating elements 10 together while maintaining their spacing. The electrical contact plate 33 has electrical contact surface(s) on one or both faces of the contact plate.

A voltage source is connected to the electrical contact plates 33 via conductors 34 that are attached to the conductive surfaces of the electrical contact plates 33. The voltage source may be a power supply 80 that is connected to a distribution box 71 via a conductor 72. The distribution box 71 is electrically connected to the electrical contact plates 33 via conductors 34. In this manner a voltage may be applied to electrical contact plates 33 which apply a voltage across a piezoelectric vibrating element 10 in order to cause a deformation of the ceramic in the piezoelectric vibrating element 10. The voltage supplied through the distribution box 71 to each actuator 12 is preferably of the same polarity, amplitude, frequency and phase so that the actuators are all operating in phase. It is within the scope of this invention however to provide different voltages (differing in polarity, phase, frequency and the like) to each actuator.

In a curved prestressed piezoelectric element 10 such as THUNDER™, the element 10 deforms becoming more curved under a voltage of one polarity, and deforms becoming less curved under a voltage of another (i.e., opposite) polarity. Starting from the element's 10 rest position (i.e., zero voltage) it has been observed that the piezoelectric vibrating element 10 exhibits a greater range of displacement under voltages that cause the element 10 to become less curved. A curved prestressed piezoelectric vibrating element 10 also generates greater force (i.e., a greater acceleration of the element's midpoint) under a voltage that flattens the element 10, than the piezoelectric vibrating element 10 does under a voltage that causes it to become more curved. In the preferred embodiment of the actuator 12, application of an oscillating voltage to the stack of elements 10 generates a high force.

Application of an oscillating voltage causes each piezoelectric vibrating element 10 and therefore the stack of piezoelectric vibrating elements 10 to vibrate at the frequency of the applied oscillating voltage. This vibration of the stack of piezoelectric vibrating elements 10 is transmitted to the actuator housing 40 and to the rigidly attached the float blade 30, thereby transmitting vibrational energy to the concrete Ml. To impart a greater force to the float blade 30, an external mass 45 may be attached to the stack of piezoelectric vibrating elements 10 using a shaft 43 or other appropriate means. The mass 45 reduces the displacement of the stack of piezoelectric vibrating elements 10, but allows a greater force to be generated and transmitted to the concrete through the float blade 30.

It will be appreciated by those skilled in the art that a vibrating finishing tool 20 incorporating the above described piezoelectric actuators 12 and mass 45 may generate greater force than prior vibrational finishing tools. The amount of force and displacement will depend on the electrical and mechanical properties of the materials of construction selected for the transducers as well as the applied voltage. Various configurations for the piezoelectric actuator exist depending on the force and displacement requirements. In the preferred embodiment of the present invention, an actuator 12 uses a stacked configuration of piezoelectric elements 10 to deliver vibrational energy of the piezoelectric element/mass combination through the actuator 12 to the attached float blade 30 and from the float blade 30 to the concrete mass M1.

Figure 10:
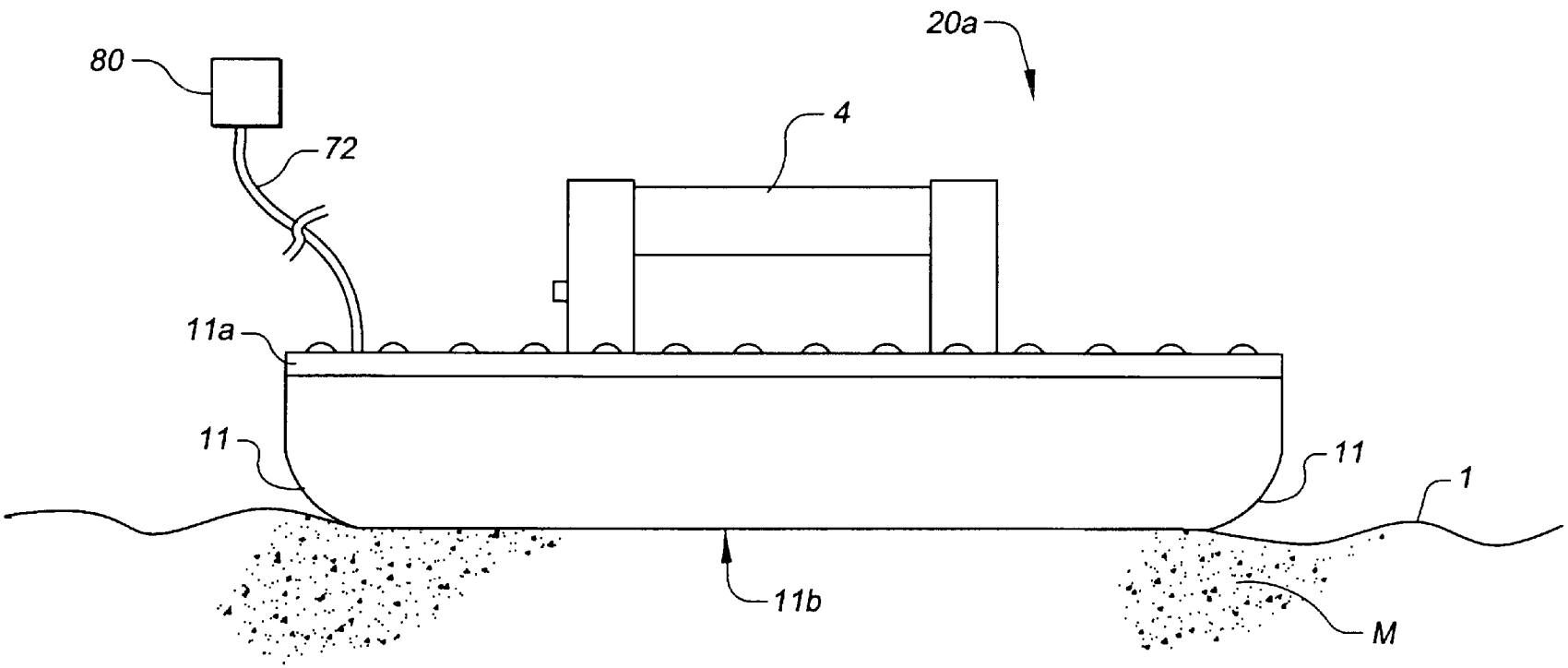
FIG. 10 is a side elevation showing the construction of an alternative finishing tool which may be used in the vibration step or finishing step of the present invention.

With reference to FIG. 10: An alternative vibrating finishing tool 20*a* for use in the vibration step 109 may comprise a handheld tool. This hand tool 20*a* may be used to vibrate any part of or the entire concrete slab, but most preferably would be used to vibrate the edges of the slab during the consolidation step 109. A suitable vibrating hand tool 20*a* is illustrated in U.S. Pat. No. 5,837,298 to Face entitled "Piezoelectrically-Actuated Vibrating Surface-Finishing Tool," and is hereby incorporated by reference. The handheld vibrating finishing tool 20*a* comprises a shell 11 within which is located piezoelectric vibrating elements. The piezoelectric vibrating elements are attached at their centers to a rib in the bottom portion 11*b* of the shell. The piezoelectric vibrating elements may have weights attached at opposite ends to increase their momentum when vibrating and the impulse they deliver. A handle 4 is attached to the top portion 11*a* of the shell 11. The vibrational energy from piezoelectric vibrating elements is transmitted to the bottom 11*b* of the shell (and thence to the work surface 1 of a concrete mass M).

The elements may have weights attached to opposite ends thereof. It will be understood that if the frequency of the electrical power supplied to the actuator element corresponds to a natural frequency of oscillation of piezoelectric vibrating elements and attached weights combination, then the amount of electrical energy required to oscillate the combination at a given amplitude of oscillation can be minimized. Accordingly, it will be appreciated that by constructing the piezoelectric vibrating element with weights and applying electrical energy to the piezoelectric vibrating elements at a frequency corresponding to a natural frequency of oscillation of the combined piezoelectric vibrating elements and attached weights, the magnitude of vibrational energy which can be generated and transmitted to the work surface 1 of a plastic concrete mass M can be maximized while the amount of electrical energy input necessary to generate the vibrational energy dutput is minimized.

While the above description contains many specificities, these should not be construed as limitations on the scope of the invention, but rather as an exemplification of one preferred embodiment thereof. Many other variations are possible, for example:

The initial floating step may use the disclosed finishing tool, in either a vibrating or non-vibrating mode;

The dry shake hardener may be applied in as little as one application or in two or more applications;

The dry shake hardener may be vibrated/consolidated into the surface layer of the concrete using either the vibrating float, or the handheld finishing tool or both;

The finishing step may be accomplished using conventional finishing tools, or a vibrating finishing tool;

The vibrating and the finishing steps may be done separately or they may be done simultaneously using the vibrating finishing tool;

The stacked configuration of the actuator need not include six piezoelectric vibrating elements but may include many more or as little as one piezoelectric vibrating element;

The piezoelectric vibrating elements need not be mounted in a stacked configuration; a clamshell configuration or a combination of clamshells and stacks may be used;

The piezoelectric vibrating elements need not be mounted in a "horizontal" configuration; a "vertically mounted" configuration with edges of the elements at the actuator top and bottom may be used;

Each actuator may have a mass mounted to the vibrating elements with the shaft or a single mass to all the shafts and may be shared between all actuators; and More than one electrical contact plate may separate individual piezoelectric vibrating elements in a stack.

What is claimed is:

1. A method of producing delamination resistant surface hardened concrete comprising the steps of:

pouring plastic concrete into a form to produce a plastic concrete mass having an exposed top surface having a first profile;

leveling and compacting said exposed top surface of said plastic concrete mass to a compacted concrete mass having an exposed top surface having a second profile more level than said first profile, said compacted concrete mass having a surface layers, a bottom layer, and an interface between said surface layer and said bottom layer having a distinct boundary;

broadcasting a first application of dry aggregate hardener onto said top surface of said compacted concrete mass;

consolidating and mixing said first application of dry aggregate hardener with said surface layer of said compacted concrete mass by vibrating said first application of dry aggregate hardener on said top surface into said surface layer with a vibrating finishing tool;

continuing said consolidating and mixing of said first application of dry aggregate hardener with said surface layer until a surface hardened concrete having a gradual interface between said surface layer and said bottom layer is produced, said gradual interface having an even distribution of aggregates which is not susceptible to delamination; and finishing a top surface of said surface hardened concrete with a finishing tool.

2. The method of claim 1, further comprising the steps of:

broadcasting a second application of dry aggregate hardener onto said top surface of said compacted concrete mass, after said step of continuing said consolidating and mixing of said first application of dry aggregate hardener;

consolidating and mixing said second application of dry aggregate hardener with said surface layer of said compacted concrete mass by vibrating said second application of dry aggregate hardener on said top surface into said surface layer with said vibrating finishing tool; and continuing said consolidating and mixing of said second application of dry aggregate hardener with said surface layer until surface hardened concrete having a gradual interface between said surface layer and said bottom layer is produced, said gradual interface having an even distribution of aggregates which is not susceptible to delamination.

3. The method of claim 2, wherein said step of finishing said top surface of said surface hardened concrete is done simultaneously with said step of continuing said consolidating and mixing of said second application of dry aggregate hardener with said vibrating finishing tool.

4. The method of claim 3, wherein said steps of consolidating and mixing said first and second applications of dry aggregate hardener with said surface layer of said compacted concrete mass comprises pushing or pulling a vibrating finishing tool over said surface layer of said compacted concrete mass;

said vibrating finishing tool comprising a vibratory float further comprising:

a float blade having a top surface and a substantially flat lower surface, said lower surface being adapted to engage said surface layer of said compacted concrete mass for consolidation and mixing;

at least one piezoelectric vibrator mechanically mounted to said top surface of said float blade, for transmission of vibration through said float blade, and from said float blade lower surface to said surface layer of said compacted concrete mass; and an elongate handle attached to said float blade top surface for pushing and pulling said float blade.

5. The method of claim 4, wherein said step of pushing or pulling a vibrating finishing tool over said surface layer of said compacted concrete mass further comprises simultaneously applying an alternating voltage to said at least one piezoelectric vibrator.

* * * * *